US009046876B2

(12) United States Patent
Villar et al.

(10) Patent No.: US 9,046,876 B2
(45) Date of Patent: Jun. 2, 2015

(54) PROTECTION OF A STRUCTURAL COMPONENT OF A TIMEPIECE

(71) Applicant: ETA SA Manufacture Horlogere Suisse, Grenchen (CH)

(72) Inventors: Ivan Villar, Bienne (CH); Laurent Kaelin, Sonvilier (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/287,706

(22) Filed: May 27, 2014

(65) Prior Publication Data

US 2014/0369172 A1 Dec. 18, 2014

(30) Foreign Application Priority Data

Jun. 14, 2013 (EP) ..... 13171983

(51) Int. Cl.

| | |
|---|---|
| ***G04B 27/02*** | (2006.01) |
| ***G04B 47/04*** | (2006.01) |
| ***G04B 29/00*** | (2006.01) |
| ***G04B 37/22*** | (2006.01) |
| ***G04B 3/04*** | (2006.01) |
| ***G04B 29/04*** | (2006.01) |
| ***G04B 37/10*** | (2006.01) |

(52) U.S. Cl.

CPC *G04B 37/22* (2013.01); *G04B 3/04* (2013.01); *G04B 29/04* (2013.01); *G04B 37/10* (2013.01)

(58) Field of Classification Search

USPC ..... 368/88, 190–193, 280, 281, 286, 288, 368/308, 318–321

See application file for complete search history.

(56) References Cited

U.S. PATENT DOCUMENTS

| | | | | |
|---|---|---|---|---|
| 420,919 | A | 2/1890 | Rauschenbach | |
| 991,552 | A | 5/1911 | Sim | |
| 1,910,908 | A * | 5/1933 | Weingartner | 368/281 |
| 2,034,651 | A * | 3/1936 | Bulova | 368/286 |
| 2,218,889 | A * | 10/1940 | Marti | 368/288 |
| 2003/0007426 | A1 | 1/2003 | Ecoffet | |
| 2005/0013202 | A1 * | 1/2005 | Hiranuma et al. | 368/206 |

FOREIGN PATENT DOCUMENTS

| | | |
|---|---|---|
| CH | 131146 | 1/1929 |
| CH | 183503 | 4/1936 |
| CH | 188684 | 1/1937 |

(Continued)

OTHER PUBLICATIONS

European Search Report issued Mar. 7, 2014, in Patent Application No. EP 13 17 1983, filed Jun. 14, 2013 (with English-language translation).

*Primary Examiner* — Vit W Miska

(74) *Attorney, Agent, or Firm* — Oblon, McClelland, Maier & Neustadt, L.L.P.

(57) ABSTRACT

Protective device (1) for the protection of a structural component, notably a main plate (2), of a timepiece movement (3) on a receiving surface comprised in this structural component (2) for receiving in abutment a complementary bearing surface (51) of a wheel set (5).

This protective device (1) includes at least one insert (6) including a slide surface (7) having a higher surface hardness than that of this structural component (2), this insert (6) being assembled on or in this structural component (2) so that this slide surface (7) thereof coincides with this receiving surface.

19 Claims, 4 Drawing Sheets

(56) References Cited

FOREIGN PATENT DOCUMENTS

| | | |
|---|---|---|
| CH | 201680 | 12/1938 |
| CH | 497 724 | 6/1970 |
| FR | 880.880 | 4/1943 |
| FR | 1 024 708 | 4/1953 |
| WO | 01/40881 A1 | 6/2001 |

* cited by examiner

PROTECTION OF A STRUCTURAL COMPONENT OF A TIMEPIECE

This application claims priority from European patent application No. 13171983.3 filed Jun. 14, 2013, the entire disclosure of which is hereby incorporated by reference.

FIELD OF THE INVENTION

The invention concerns a protective insert for the protection of a housing forming a surface of revolution generated by a given profile in a structural component, notably a main plate, of a timepiece having a given surface hardness, said insert including at least one slide surface having a higher surface hardness than said given surface hardness, said insert including at least one machined portion of revolution about an axis of revolution whose profile is complementary to said given profile.

The invention further concerns a structural component of a timepiece movement, having a given surface hardness, and including at least one housing forming a surface of revolution generated by a given profile, said structural component including a protective device arranged for receiving in abutment a complementary bearing surface of a wheel set of said movement on a theoretical receiving plane.

The invention concerns a timepiece mechanism including at least one wheel set including at least one complementary bearing surface and including at least one structural component and/or insert of this type, for receiving at least said wheel set.

The invention also concerns a watch including a timepiece mechanism of this type.

The invention concerns the field of timepiece mechanisms.

BACKGROUND OF THE INVENTION

Timepiece mechanisms are very liable to wear and some components, particularly those made of copper alloys, suffer from friction with an opposing component made of harder material, for example a steel alloy.

Thus, in a manual winding mechanism, a winding stem operated by the crown drives, with radial guiding, a winding pinion which meshes on a transmission wheel transmitting the rotation to a ratchet wheel on the barrel, directly or via a gear train. This winding pinion, generally made of steel, is axially guided and supported on an edge of the main plate of the movement, which is generally made of brass or similar. Wear rapidly occurs in this area of contact, and may require replacement of the main plate, which is expensive.

FR Patent Application No 880880A in the name of DEPERY describes an arrangement of balance staffs with pivots engaged in jewel holes formed by hollow screws fixed to the plates, with said screws axially receiving axial screws acting as endstones.

CH Patent Application No 188684A in the name of LA CHAMPAGNE describes a shock absorber bearing with a smooth, stepped, shock absorber, jewel hole.

CH Patent Application No 201680A in the name of FELSA describes a bushing housed in a bore in a plate and carrying a distinct fixed pivot projecting into said bore. A cylindrical shoulder integral with the arbour of a wheel set is slid onto the pivot, the arbour being fitted with limited endshake inside the recess formed by the bore and the pivot.

FR Patent Application No 1024708A in the name of ERISMAN describes a pivot with a hard metal coating, notably made of chromium.

WO Patent Application No 01/40881A1 in the name of KS22 SA-ECOFFET describes a watch crown screwed onto a sleeve assembled inside the watch case.

CH Patent Application No 497724A in the name of RECORD WATCH CO SA describes a winding mechanism wherein the axial position of the winding stem is determined by an elastically deformable fixed insert.

U.S. patent application Ser. No. 420,919A in the name of RAUSCHENBACH describes a winding mechanism provided with an insert.

CH Patent Application NO 131146A in the name of GISIGER UHRENFABRIKATIONS describes a winding mechanism including a sleeve.

SUMMARY OF THE INVENTION

Rather than changing the material of the main plate, which has an effect on the cost and weight of the movement, the invention proposes to modify inexpensively an existing main plate to ensure that it has an equivalent longevity to the other components of the watch or timepiece.

The invention therefore concerns a protective insert for the protection of a housing forming a surface of revolution generated by a given profile in a structural component, notably a main plate, of a timepiece having a given surface hardness, said insert including at least one slide surface having a higher surface hardness than said given surface hardness, said insert including at least one machined portion of revolution about an axis of revolution whose profile is complementary to said given profile. characterized in that said insert includes at least one complementary, first, flat indexing surface perpendicular to said axis of revolution, and at least one complementary, second, flat indexing surface parallel to said axis of revolution, and in that at least said complementary first indexing surface forms a said slide surface having a higher surface hardness than said given surface hardness.

The invention further concerns a structural component of a timepiece movement, having a given surface hardness, and including at least one housing forming a surface of revolution generated by a given profile, said structural component including a protective device arranged for receiving in abutment a complementary bearing surface of a wheel set of said movement on a theoretical receiving plane, characterized in that said protective device includes at least one said insert assembled on or in said structural component in a said housing so that said flat slide surface coincides with said theoretical receiving plane, and characterized in that said structural component includes a rotation stop surface arranged to cooperate with a complementary rotation stop surface comprised in said insert, said insert is fixedly held in relation to said structural component after the initial mounting thereof in or on said structural component, and so as to keep said wheel set at a distance from said structural component and out of contact therewith, and said insert is removable for replacement when worn out.

In a specific variant, said structural component is a watch main plate.

In a specific variant, said structural component is a middle part of a watch.

In a specific variant, said structural component is a watch casing ring.

The invention concerns a timepiece mechanism including at least one wheel set including at least one complementary bearing surface and including at least one structural component and/or insert of this type, for receiving at least said wheel set.

More specifically, said timepiece mechanism is a winding mechanism for a watch, said wheel set is a winding pinion, and said structural component includes a bore along an axis for guiding the pivoting of a winding stem, which is also guided in a bore of said insert when the latter is in the bearing position stopped on said structural component for guiding the pivoting of a winding stem.

The invention also concerns a watch including a timepiece mechanism of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
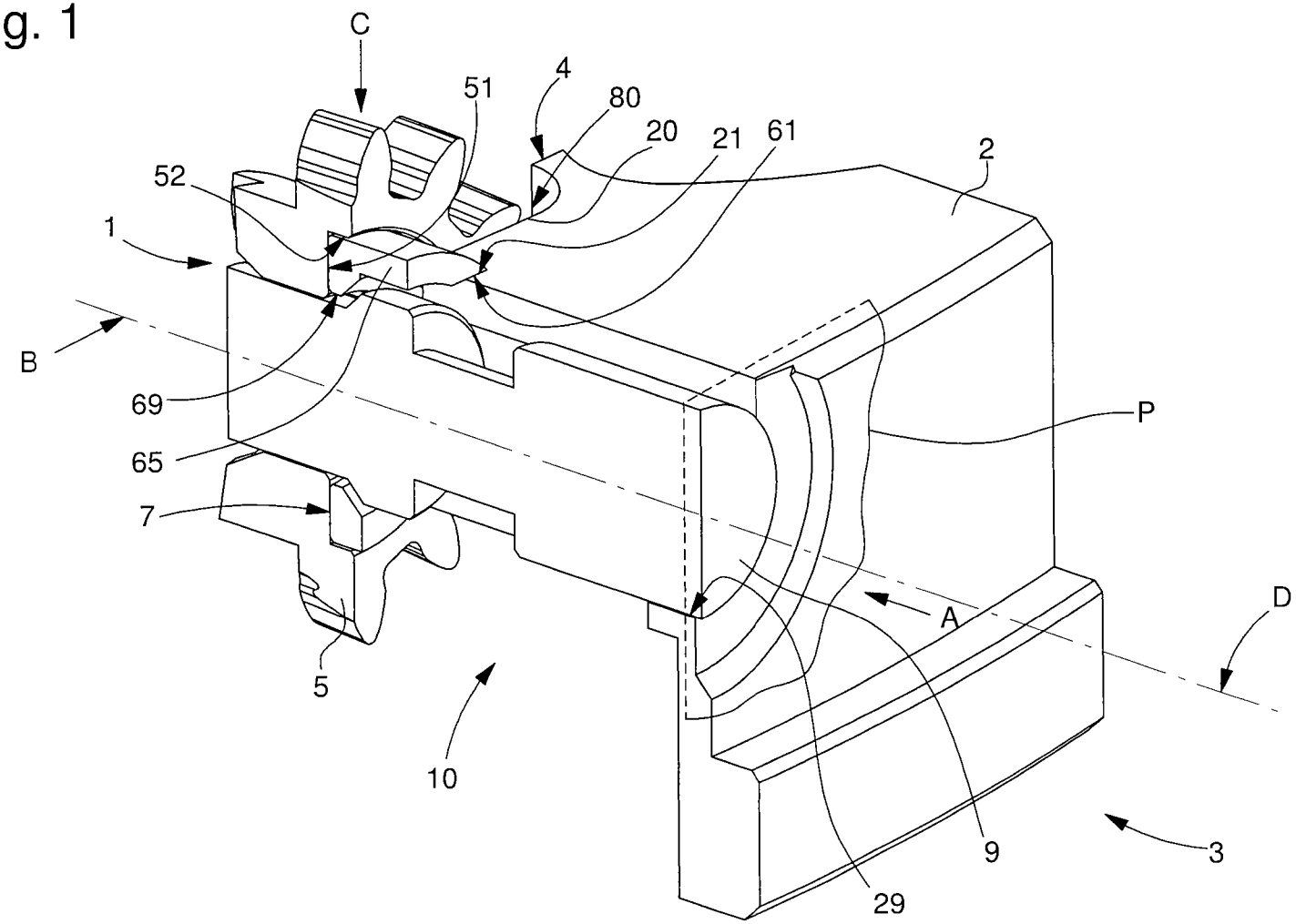
FIG. 1 shows a schematic, perspective cross-section in a plane through a winding stem axis, of a protective device for a structural component, notably a main plate, according to the invention, in a particular application to the protection of an edge of the plate serving as a bearing face for a wheel set such as a winding pinion, in a timepiece winding mechanism, by the insertion of a particular insert between the plate and said wheel set, supported on a surface of the plate.
Figure 3:
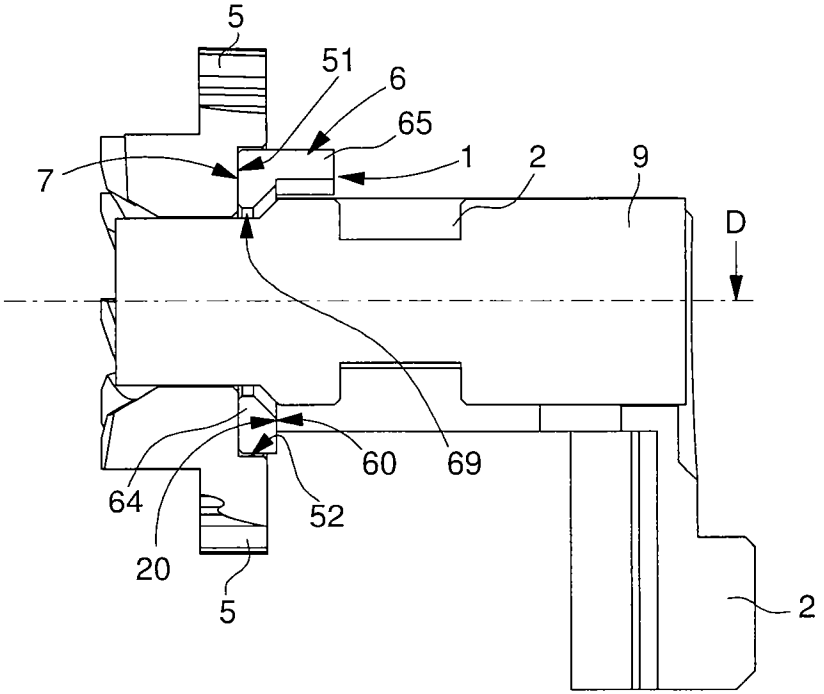
FIG. 3 shows a schematic cross-section in the cross-sectional plane of FIG. 1, seen at B, of the device of FIG. 1.
Figure 2:
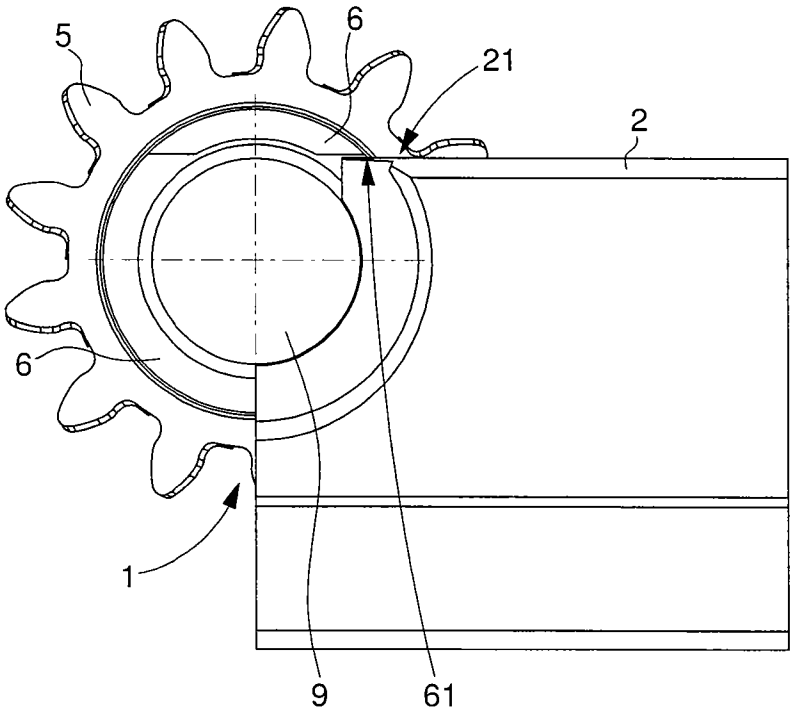
FIG. 2 shows a schematic, partial cross-section in a plane P at end view A, of the device of FIG. 1.

The invention concerns the field of timepiece mechanisms, in which an operational wheel set is theoretically bearing directly or indirectly on a theoretical reference surface, which is generally flat, in relation to another component, which will be referred to here as a "structural component".

A "wheel set" means here any timepiece component mounted mobile in rotation and/or translation in a mechanism.

It is understood that the structural component according to the invention may take various forms. It may form a plate in the usual sense of the term, or any timepiece movement component, or any external timepiece component, subjected to friction wear. It is an object of the invention to protect the structural component, in particular when it is expensive owing to the machining complexity and/or material thereof, for example a plate or watch case made of gold.

To ensure the protection of this type of structural component, the invention concerns a protective insert 6 for the protection of a housing forming a surface of revolution generated by a given profile in a structural timepiece component 2, which structural component 2 has a given surface hardness. Insert 6 includes at least one slide surface 7 having a higher surface hardness that the given surface hardness. Insert 6 includes at least one machined portion of revolution about an axis of revolution D, complementary to said given profile.

According to the invention, this insert 6 includes at least one complementary, first, flat, indexing surface 61 perpendicular to said axis of revolution D, and at least one complementary second, flat, indexing surface 62 parallel to axis of revolution D; and at least the complementary first indexing surface 61 forms a said slide surface 7 having a higher surface hardness than the given surface hardness.

The invention also concerns a structural component 2 of a timepiece movement 3 having a given surface hardness, and including at least one housing 8 forming a surface of revolution generated by a given profile.

This structural component 2 includes a protective device 1, which is provided for receiving in abutment a complementary bearing surface 51 of a wheel set 5 of movement 3 on a theoretical receiving surface, and more specifically on a theoretical bearing plane.

According to the invention, this protective device 1 includes at least one insert 6 of this type which is assembled on or in structural component 2 in a housing 8, so that the flat slide surface 7 thereof coincides geometrically with said theoretical receiving surface, and more specifically said theoretical receiving plane.

Structural component 2 includes a rotation stop surface, which is arranged to cooperate with a complementary rotation stop surface comprised in insert 6, said insert is held stationary in relation to structural component 2 after the initial assembly thereof in or on said structural component 2, and so as to keep wheel set 5 at a distance from structural component 2 and out of contact therewith. Insert 6 is removable for replacement in the event of wear. It is understood that in the operating position, insert 6 is in a fixed position in relation to the structural component, from which it is disassembled only for replacement due to wear.

In a particular variant illustrated in the Figures, the rotation stop means includes at least a first flat indexing surface 21, which is arranged to cooperate in abutment with a complementary first flat indexing surface 61 comprised in insert 6 and which appertains to the complementary rotation stop means.

Figure 8:
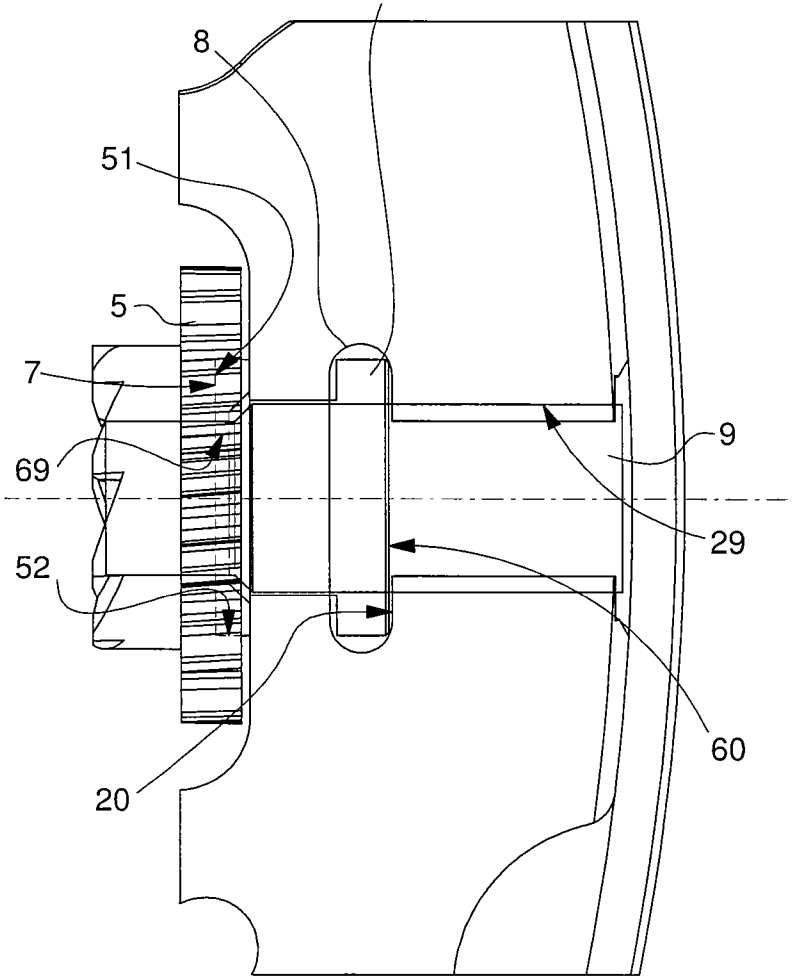
FIG. 8 shows a schematic top view, in a similar manner to FIG. 4, of another mechanism embodiment wherein the plate includes a notch into which an insert is slid from above.

Insert 6 is preferably positioned in axial abutment, or bearing on at least one bearing surface 20 of structural component 2 as seen in FIGS. 1 to 4, or in a housing 8 of structural component 2 as seen in FIG. 8.

Insert 6 is not joined to structural component 2 which enables it to be replaced.

Figure 5:
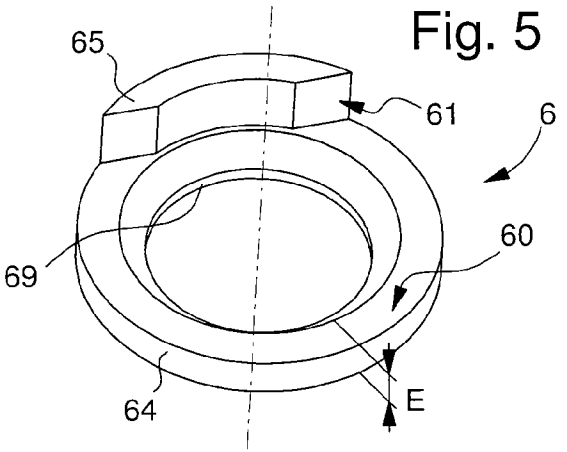
FIG. 5 shows a schematic, perspective view of the insert of the device of FIG. 1, including a surface for angular indexing on the plate.

In the preferred embodiment of the invention, as seen in FIGS. 1 to 4 and 8, structural component 2 includes at least a first indexing surface 21, which is arranged to cooperate in abutment with a complementary first indexing surface 61 comprised in insert 6. In FIGS. 1 to 4, insert 61 includes a single complementary indexing surface 61, which is flat, as seen in FIG. 5, the first indexing surface 21 is then a flat portion. It is therefore easy to angularly index insert 6 in relation to structural component 2 and to define the relative position thereof, here in direction C of FIG. 1. When, as in the Figures, structural component 2 includes a bore 29 and insert 6 includes a bore 69, it is thus easy to position them in relation to each other, and notably to place them in the same plane if alignment is required.

In the particular non-limiting application to a winding mechanism, illustrated in the Figures, insert 6 is centred in a recess of wheel set 5, which is a winding pinion here. A recess with a flat portion, forming this complementary first indexing surface 61 on insert 6, angularly locks the insert on structural component 2. Protective device 1 is devised for vertical insertion, i.e. in direction C of FIG. 1, which is very simple and requires no pre-assembly of insert 6 on structural component 2.

The material of insert 1 may be chosen from among copper alloys, steel alloys, synthetic materials, synthetic ruby, or other materials.

In a very economical variant of the invention, insert 6 seen in FIGS. 1 to 5 includes a main body of revolution 6 in the form of a washer, carrying at least one bore 69, and, projecting from said body 6, a boss 65 including a complementary indexing surface 61. Insert 6 is thus made roughly in the form of a cut washer, and is finished simply by milling, delimiting on the one hand, the complementary indexing surface 61, and on the other hand, a complementary bearing surface 60 intended to bear upon bearing surface 20 of structural component 2. Insert 6 may also be created by stamping, or by plastic injection moulding. It is equally simple to transform an existing plate, by the lateral milling of a recess corresponding to the thickness E of body 6 of insert 6, and possibly a surface milling of the first indexing surface 21, in the case where the structural component 2 concerned is not flat in this area.

Figure 7:
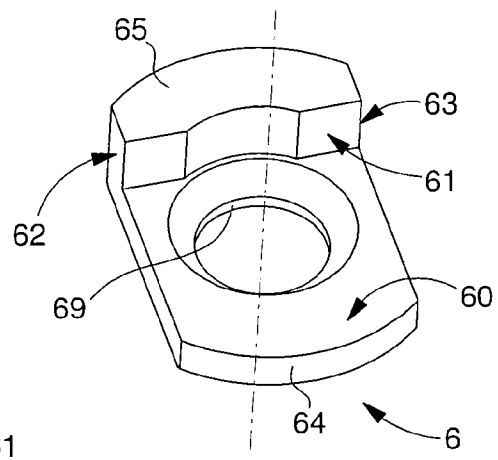
FIG. 7 shows a schematic perspective view of another insert embodiment including two angular indexing faces perpendicular to each other, and a third face parallel to one of the other two faces.
Figure 6:
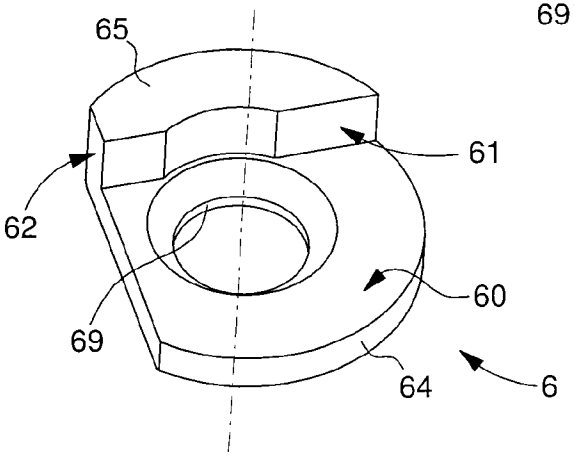
FIG. 6 shows a schematic perspective view of an insert embodiment including two angular indexing faces perpendicular to each other.
Figure 4:
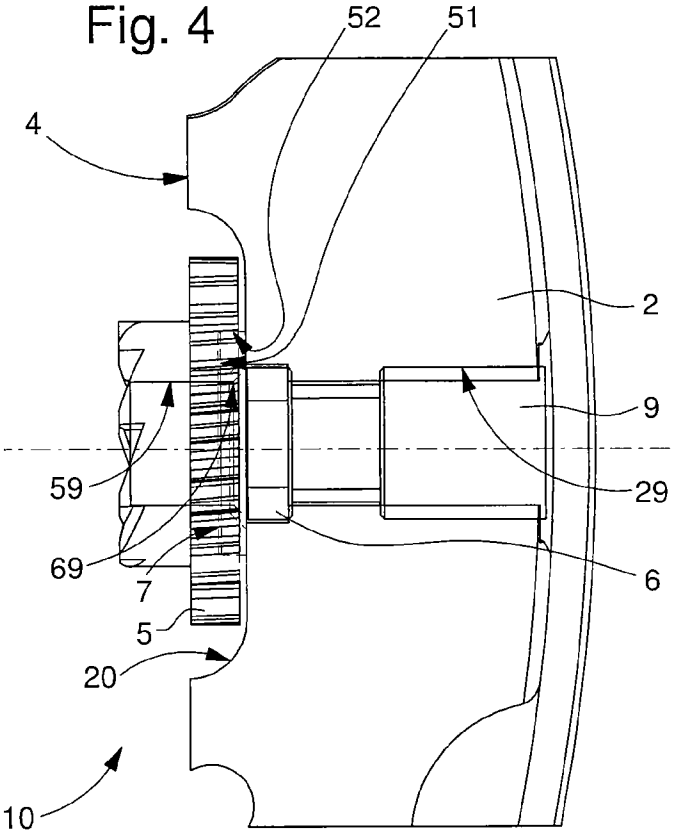
FIG. 4 shows a schematic top view in direction C of the device of FIG. 1.
Figure 9:
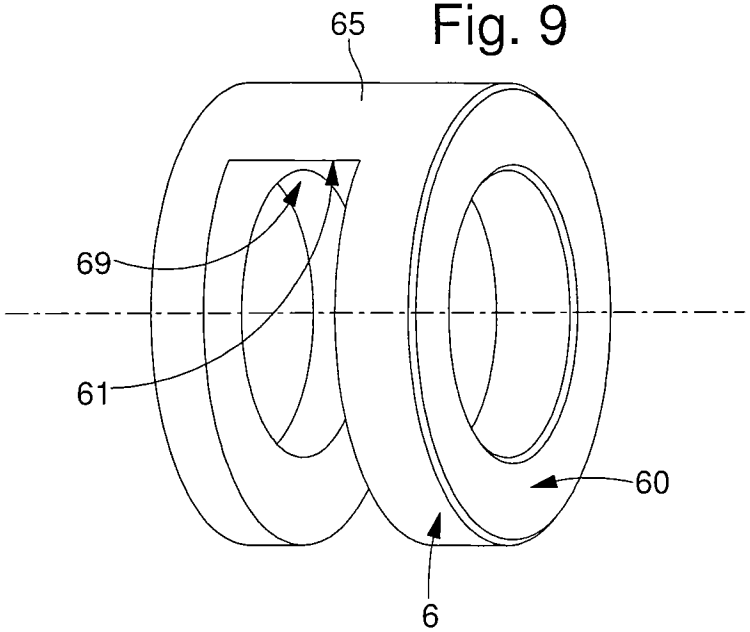
FIG. 9 shows a schematic, perspective view of a stirrup-shaped insert embodiment suitable for the mechanism of FIG. 8.
Figure 10:
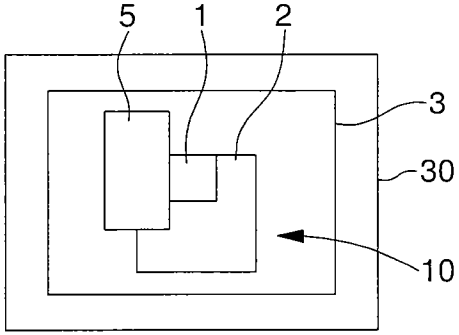
FIG. 10 shows a block diagram of a watch including a movement with a plate equipped with a device for protection against wear caused by friction from a wheel set.

In a variant, structural component 2 includes at least a second indexing surface 22 arranged to cooperate in abutment with a complementary second indexing surface 61 comprised in insert 6. As seen in FIG. 6 illustrating a non-limiting example embodiment, second indexing surface 22 is distinct from first indexing surface 21, and complementary second indexing surface 61 is distinct from complementary first indexing surface 61. In the same example in FIG. 6, the second indexing surface 22 is flat and oblique in relation to said first indexing surface 21 which is flat, and complementary second indexing surface 62 is flat and oblique in relation to complementary first indexing surface 61 which is flat. More specifically, second indexing surface 22 is perpendicular to first indexing surface 21 and complementary second indexing surface 62 is perpendicular to complementary first indexing surface 61. This arrangement thus allows for the precise three-dimensional positioning of insert 6 in relation to structural component 2 and the correct alignment of their respective bores 69 and 29. FIG. 7 illustrates yet another insert embodiment 6 including two angular indexing surfaces 61 and 62 perpendicular to each other, and a third face 63 parallel to one 62 of the other two faces.

In numerous watch applications and particularly in the application shown in the Figures of a movement 3 including a winding mechanism, structural component 2 includes at least a bore 29 along an axis D for the guiding in pivoting of a stem 9. Thus the employment of an inset 6 according to the invention, in addition to protecting the edge face of structural component 2, results in less wear on said bore 29 while providing at least one guide shoulder for a stem 9.

For this purpose, insert 6 advantageously includes at least one bore 69 for guiding the pivoting of a stem 9. In a specific manner, bore 69 is treated or coated with an anti-wear treatment or coating, or insert 6 is itself equipped with a ring, including bore 69, said ring being made of a suitable material or treated or coated with an anti-wear treatment or coating.

Protective device 1 is advantageously used in a mechanism wherein bore 69 of insert 6 and bore 29 of structural component 2 are aligned in the assembly position of insert 6 on structural component 2.

In a specific variant, the structural component is a watch main plate.

In a specific variant, the structural component is a middle part of a watch.

In a specific variant, the structural component is a watch casing ring.

The invention concerns a timepiece mechanism 10 including at least one wheel set 5 including at least one complementary bearing surface 51 and including a structural component 2 and/or an insert 6 for receiving said wheel set 5.

A timepiece movement 3 including a timepiece mechanism 10 of this type advantageously includes a structural component 2 which is arranged to receive, in the same direction of insertion during assembly, insert 6 and wheel set 5 preferably perpendicularly to axis D and in direction C of FIG. 1, and includes a chamber 80 (set back from a front surface 4) in which at least insert 6 is movable in a plane perpendicular to axis D in the absence of a stem 9 and wherein insert 6 is immobilised in a single position when a said stem 9 is inserted into bore 69 of insert 6 and bore 29 of structural component 2.

Slide surface 7 of insert 6 is preferably perpendicular to axis D.

The particular case of the Figures illustrates a winding mechanism 10 of a watch 30, wheel set 5 is a winding pinion and structural component 2 includes a bore 29 along an axis D for guiding the pivoting of a winding stem 9, which is also guided in a bore 69 of insert 6 when the latter is in the bearing position abutting on structural component 2 for guiding the pivoting of stem 9.

The invention also concerns a timepiece movement 3 including at least one said mechanism 10 and/or one said structural component 2 equipped with a said protective device 1 for the protection thereof during the motion of a wheel set 5 comprised in said movement 3 and wherein insert 6 is either held in structural component 2 by a stem 9 inserted both into a bore 29 of axis D in the plate and in a bore 69 in said insert 6 aligned with bore 29 of structural component 2, or movable in relation to structural component 2 in a perpendicular plane to axis D.

The invention further concerns a watch 30 including a timepiece movement 3 and/or a timepiece mechanism 10 of this type.

Thus, the invention eliminates the wear of the structural component, particularly in a manual winding mechanism. The invention allows for the re-utilisation of an existing structural component, particularly a main plate, at minimal transformation cost, with a very inexpensively produced insert. After-sales interventions concern only the insert and no longer the structural component.

The invention claimed is:

1. A protective insert for the protection of a housing forming a surface of revolution generated by a given profile in a structural component of a timepiece having a given surface hardness, said insert including at least one slide surface having a higher surface hardness than said given surface hardness, said insert including at least one machined portion of revolution about an axis of revolution whose profile is complementary to said given profile, wherein said insert includes at least one complementary, first, flat indexing surface perpendicular to said axis of revolution, and at least one complementary, second, flat indexing surface parallel to said axis of revolution, and in that at least said complementary first indexing surface forms a said slide surface having a higher surface hardness than said given surface hardness.

2. A structural component of a timepiece movement having a given surface hardness, and including at least one housing forming a surface of revolution generated by a given profile, said structural component including a protective device arranged to receive in abutment a complementary bearing surface of a wheel set of said movement on a theoretical receiving plane, wherein said protective device includes at least one insert according to claim 1, assembled on or in said structural component in a said housing so that said flat, slide surface thereof coincides with said theoretical receiving plane, and wherein said structural component includes a rotation stop surface arranged to cooperate with a complementary rotation stop surface comprised in said insert, said insert is fixedly held in relation to said structural component after the initial mounting thereof in or on said structural component, and so as to keep said wheel set at a distance from said structural component and out of contact therewith, and said insert is removable for replacement due to wear.

3. The structural component according to claim 2, wherein said rotation stop surface includes at least a first, flat, indexing surface, in that said complementary rotation stop surface includes a complementary first, flat indexing surface, and in that said first flat indexing surface is arranged to cooperate in abutment with said complementary first indexing surface.

4. The structural component according to claim 2, wherein said insert is positioned in a fixed position, in axial abutment, either on at least one bearing surface of said structural component or in said housing of said structural component.

5. The structural component according to claim 2, wherein said structural component includes at least a second indexing surface arranged to cooperate in abutment with a complementary second indexing surface comprised in said insert.

6. The structural component according to claim 5, wherein said second indexing surface is distinct from said first indexing surface and in that said complementary second indexing surface is distinct from said complementary first indexing surface.

7. The structural component according to claim 6, wherein said second indexing surface is flat and oblique in relation to said first indexing surface which is flat, and in that said complementary second indexing surface is flat and oblique in relation to said complementary first indexing surface which is flat.

8. The structural component according to claim 6, wherein said second indexing surface is perpendicular to said first indexing surface and in that said complementary second indexing surface is perpendicular to said complementary first indexing surface.

9. The structural component according to claim 2, wherein said structural component includes at least one bore along an axis for guiding the pivoting of a stem.

10. The structural component according to claim 2, wherein said inset includes at least one bore for guiding the pivoting of a stem.

11. The structural component according to claim 10, wherein said bore of said insert and a bore of said structural component are aligned in the assembly position of said insert on said structural component.

12. The structural component according to claim 10, wherein the component includes a chamber into which said insert is insertable in a perpendicular plane to said axis in the absence of a said stem, and inside which said insert is immobilised in a single position when a said stem is inserted into said bore of said insert and said bore of said structural component so as to hold said insert immobile in relation to said structural component after the assembly thereof in or on said structural component and after the insertion of said stem.

13. The structural component according to claim 9, wherein said slide surface is perpendicular to said axis.

14. The structural component according to claim 2, wherein the component is a watch plate.

15. The structural component according to claim 2, wherein the component is a middle part of a watch.

16. The structural component according to claim 2, wherein the component is a watch casing ring.

17. A timepiece mechanism including at least one wheel set including at least one complementary bearing surface and including at least one said structural component according to claim 2 for receiving said wheel set.

18. The timepiece mechanism according to claim 17, wherein the mechanism is a winding mechanism for a watch, in that said wheel set is a winding pinion, and in that said structural component includes a bore along an axis for pivotally guiding a winding stem, which is also guided in a bore of said insert when said insert is in the bearing position in abutment on said structural component for guiding the pivoting of a stem.

19. A watch including a timepiece mechanism according to claim 17.

* * * * *